United States Patent [19]

Smith

[11] Patent Number: 4,545,481

[45] **Date of Patent: * Oct. 8, 1985**

[54] STENCILLING DEVICE

[75] Inventor: Dwight Smith, Harbor City, Calif.

[73] Assignee: Marvin Elkins, San Diego, Calif. ; a part interest

[ * ] Notice: The portion of the term of this patent subsequent to Oct. 16, 2001 has been disclaimed.

[21] Appl. No.: 650,867

[22] Filed: Sep. 14, 1984

Related U.S. Application Data

[63] Continuation-in-part of Ser. No. 486,325, Apr. 19, 1983, Pat. No. 4,476,976.

[51] Int. Cl.[4] ..... B65D 25/08; B32B 29/00

[52] U.S. Cl. ..... 206/219; 206/221; 383/38

[58] Field of Search ..... 206/219, 221, 220; 383/38

[56] References Cited

U.S. PATENT DOCUMENTS

| | | | |
|---|---|---|---|
| 2,916,197 | 12/1959 | Detrie et al. | 206/221 |
| 2,932,383 | 4/1960 | Bollmeier et al. | 206/219 |
| 3,074,544 | 1/1963 | Bollmeier et al. | 206/219 |
| 3,082,867 | 3/1963 | Gelpey | 206/221 |
| 3,156,352 | 11/1964 | Hayhurst | 206/219 |
| 3,257,072 | 6/1966 | Reynolds | 206/219 |
| 3,294,227 | 12/1966 | Schneider et al. | 206/219 |
| 3,542,032 | 11/1970 | Spencer, Jr. | 383/38 |
| 3,809,224 | 5/1974 | Greenwood | 206/219 |
| 4,402,402 | 9/1983 | Pike | 206/221 |
| 4,476,976 | 10/1984 | Smith | 206/221 |

*Primary Examiner*—William T. Dixson, Jr.
*Assistant Examiner*—Brenda J. Ehrhardt
*Attorney, Agent, or Firm*—Edward A. Sokolski

[57] ABSTRACT

A compartmented pouch has two or more sealed compartments formed therein, these compartments being separated from each other by separator means which forms a sealing separator therebetween. One of the compartments has a stencil formed therein which may be in the form of holes punched in one wall of the compartment arranged to form a desired marking image which may be letters, numerals or symbols. In lieu of punched holes, the images may be formed by slots in this compartment wall. Removable tape is placed over the holes or slots. One of two fluid components is placed in one compartment and another of two fluid components is placed in another compartment which may or may not be the compartment having the images formed therein; these two components forming an etching or marking material when combined together. When it is desired to perform the etching operation, the separator means is mechanically actuated to remove this sealing separation between the compartments such that the fluids are mixed with each other thereby forming the etching or making medium. The tape covering the holes or slotted portions forming the marking image is removed and the stencil is placed against the surface to be marked, the etching or marking medium being permitted to pass through the holes or slots in the stencil and onto the surface to be marked. In another embodiment, a single fluid may be employed which is contained in one of the compartments.

5 Claims, 12 Drawing Figures

STENCILLING DEVICE

This application is a continuation in part of my application Ser. No. 486,325 filed Apr. 19, 1983 now U.S. Pat. No. 4,476,976.

This invention relates to apparatus for stencilling markings on an object, and more particularly to such a device employing a compartmentalized pouch having a compartment containing an etching or marking medium or such a device containing a different fluid in each of two or more compartments which are joined together to form such marking or etching medium.

In my patent application Ser. No. 486,325 filed Apr. 19, 1983 a stencilling device is described which provides a sealed packet containing one or more fluids needed for etching or painting symbols on a surface which can be employed by untrained person without the use of any special protective clothing or gloves. In this device, a compartmentalized pouch is employed having a plurality of compartments which are separated from each other by break-away sealing partitions. One of these compartments may contain a first fluid while an adjacent compartment may contain a second fluid which, when combined with the first, forms an active etching or painting substance. In another embodiment of the invention, a single active fluid may be contained in one of the compartments. The second compartment may also have a stencil forming the identification letters, symbols or markings to placed on the surface of the object to be marked, this stencil being formed by holes punched though the compartment wall, or slots formed in such wall. This stencil is covered over by a tape so that the substance is not released therefrom until the tape is removed and the stencil placed on the surface to be marked.

The device of the present invention is a modification of that of my prior application in that rather than employing a break-away sealing partition, other types of separator means for forming a sealing separator between the compartments are employed. Such separator means may comprise a mechanical clamp which can be mechanically actuated to open the separation between the compartments; a valve installed in the pouch between the compartments; a frangible separator which can easily be broken with finger pressure; a seal which can be punched by an external piercing member; an internal tear seal; etc.

It is therefore an object of this invention to provide an improved device for placing identification markings on objects.

It is a further object of this invention to minimize the hazards involved in etching markings onto the surface of objects.

It is another object of this invention to provide a simple device and technique for marking objects which can be employed by unskilled personnel with minimal hazard of injury.

Other objects of this invention will become apparent as the description proceeds in connection with the accompanying drawings of which:

The device of the present invention is similar to that described in my aforementioned application Ser. No. 486,325 except for the separator means employed for forming a sealing separator between the two compartments. Therefore the aforementioned patent application is incorporated herein by reference and the subject matter thereof will be but briefly described with only the newly added portion of the present invention being described in detail.

Figure 3:
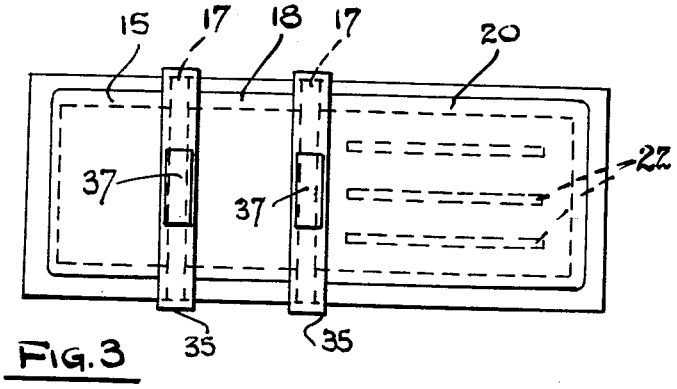
FIG. 3 is a top plan view of a second embodiment of the invention.
Figure 1:
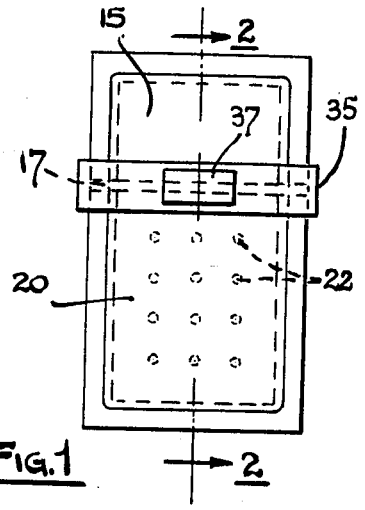
FIG. 1 is a top plan view of a first embodiment of the invention.
Figure 2:
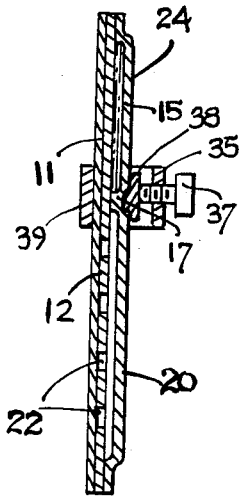
FIG. 2 is a cross-sectional view taken along the plane indicated by 2—2 in FIG. 1.

Referring now to FIGS. 1 and 2 a first embodiment of the invention is illustrated. A pouch member has a first compartment 15 and a second compartment 20 separated from each other by the action of clamp 17 which forms separator means therebetween which can be mechanically released to permit fluid flow between the two compartments. The clamp shown for illustrative purposes is a conventional laboratory type tubing clamp as illustrated in greater detail in FIG. 7 and includes a frame 35, having a screw 37 threadably mounted thereon with a bar member 38 fitted between the screw and the base 39 of the clamp, which clamps the pouch and prevents fluid flow between compartment 15 and 20 when the screw is tightened thereagainst; flow between the compartments being permitted when the screw is loosened. The pouch may be of typical materials specified in my aforementioned patent application Ser. No. 486,325 with a stencil 22 formed in the lower wall 12 of compartment 20, this stencil being formed by punched holes or slots in inside wall 12. A sealing tape 11 is removably adhered to wall 12 to cover up the stencil, this layer being removed when the etchant or other marking medium is ready for use in marking the object. Various examples of implementations of the invention to form a marking medium are fully described in my aforementioned application Ser. No. 486,325 and the material thereof is incorporated herein by reference and will not be here repeated.

Figure 4:
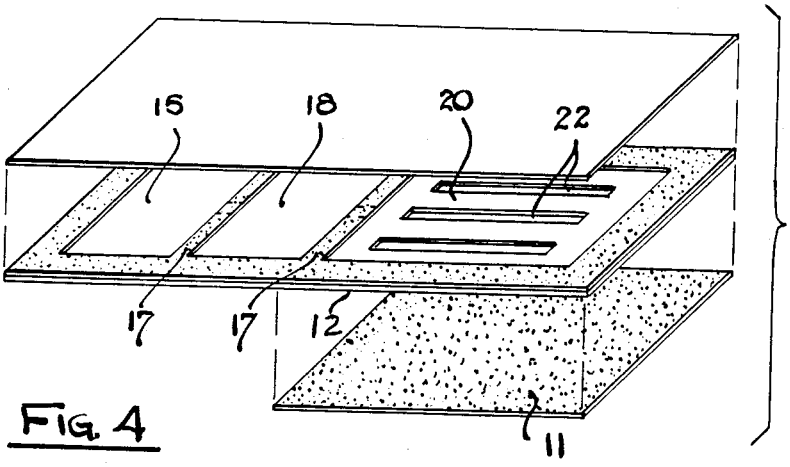
FIG. 4 is an exploded view of the second embodiment.

Referring now to FIG. 4 a second embodiment of the invention is illustrated, this embodiment being the same as that of FIG. 4 of my aforementioned patent application except for the separator means employed. In this embodiment, three compartments are employed, the compartments, as in the previous embodiment, being separated from each other by separator means such as a clamp or the like. The first compartment 15 has one of the two fluids contained therein, while compartment 18 has the other of the fluids to be mixed with the first fluid to form the marking substance. Compartment 20 has stencil 22 on its bottom surface, this stencil being sealed by tape 11 as in the first embodiment. The compartments 15, 18 and 20 are separated from each other by separator means 17 which may comprise a clamp as in the first embodiment. The fluid in compartment 15 may be forced out of this compartment into compartment 18 where the fluids are mixed to form the marking substance. When the materials have been thoroughly mixed, the mixture in compartment 18 is caused to flow into compartment 20. The material in compartment 20 is then used to etch the desired surface, as in the previous embodiment.

Figure 5:
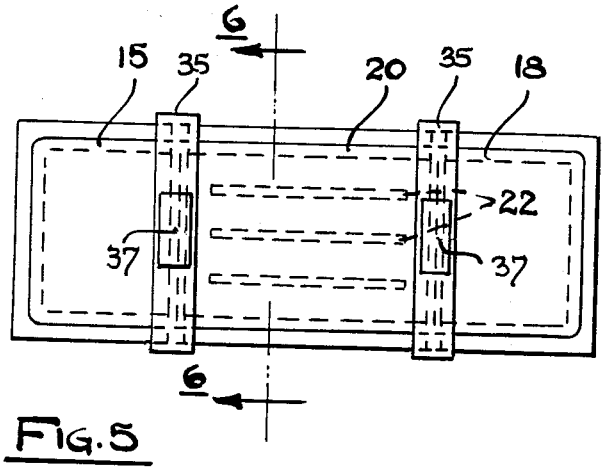
FIG. 5 is a top plan view of a third embodiment of the invention.
Figure 6:
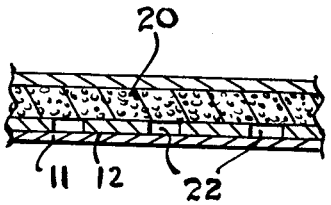
FIG. 6 is a cross-sectional view taken along the plane indicated by 6—6 in FIG. 5.

Referring now to FIGS. 5 and 6, a further embodiment of the invention is illustrated. This embodiment is similar to that of FIG. 4 except for the fact that compartments 15 and 18, rather than being adjacent to each other, are on opposite ends of compartment 20 in this embodiment. The fluids in compartment 15 and 18 are flowed into compartment 20 where the mixing thereof is achieved. Otherwise, this embodiment is the same as that of FIG. 4.

Referring now to FIGS. 7–12, various different types of separator means for providing separation between the pouch compartments which can be mechanically actuated to remove such sealing separation are illustrated.

Figure 7:
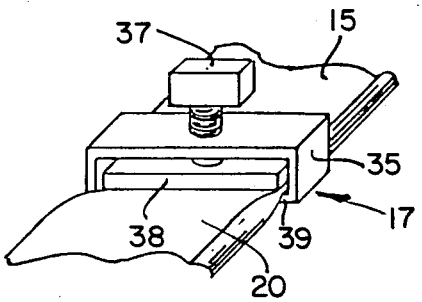

In FIG. 7 a conventional laboratory tubing clamp is shown, this clamp having been already described.

Figure 8:
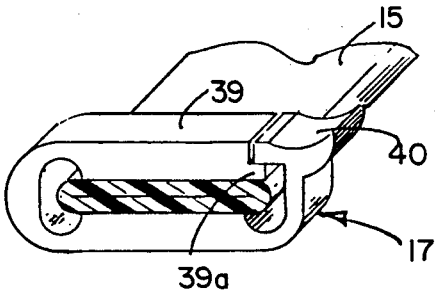

In FIG. 8 a plastic retainer clip mechanism 17 is shown. This mechanism has a resilient arm 39 which has a catch 39*a* which snaps under thumbpiece 40. Thus this clamp mechanism is operated by snapping resilient arm 31 under thumbpiece 40 as shown in the drawing with the clamp being released by downward thumb action on the thumbpiece.

Figure 9:
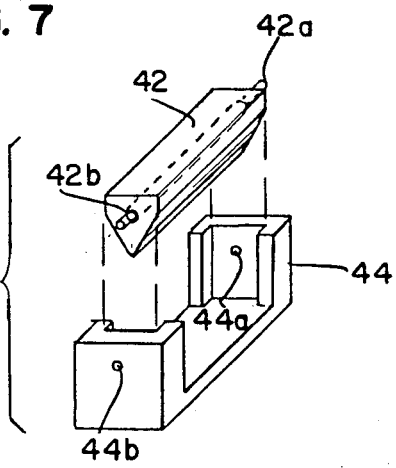

In FIG. 9 is an exploded view of a wedge type clamp which comprises a wedge member 42 having pins 42*a* and 42*b* on the opposite ends thereof. The pouch member (not shown) is clamped between wedge member 42 and holder member 44 with the wedge being retained in the holder by means of pins 42*a* and 42*b* which fit into mating apertures 44*a* and 44*b* formed in holder member 44.

Figure 10:
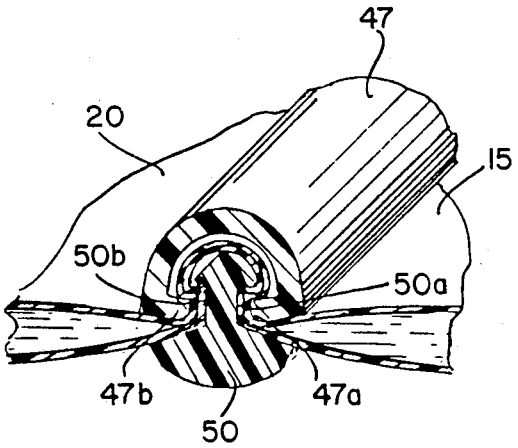

FIG. 10 illustrates still another type of clamping member which my be employed for forming a separator means between compartments 15 and 20. This clamping member has a semi-circular slide clamping member 47 which has a pair of rails 47*a* and 47*b* which ride in tracks 50*a* and 50*b* respectively formed in mating clamp member 50. The pouch is effectively clamped between members 47 and 50 at the opposing faces of rails 47*a* and 47*b* and tracks 50*a*, 50*b* respectively.

Figure 11:
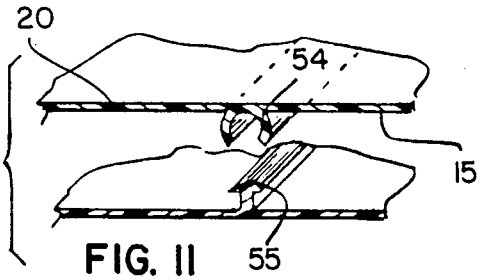

Referring now to FIG. 11, separator means in the form of a Ziploc fastener is illustrated, the separator means being formed by interlocking members 54 and 55 of the fastener, compartments 15 and 20 being formed on opposite sides of this closure.

Figure 12:
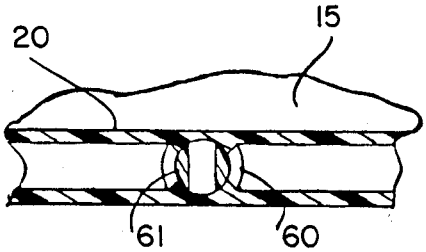

Referring now to FIG. 12, still another type of separator means which may be employed is illustrated, this separator means being in the form of a valve having a valve body 60 embedded in the pouch between compartments 15 and 20 and having a rotatable valve cock 61 installed therein which can be manually rotated to either prevent fluid communication between compartments 15 and 20 or to permit such fluid communication.

It should be apparent that many other additional types of separator means for achieving the desired end results in applicant's device can be employed such as, for exmple, a frangible glass or plastic member which collapses and permits fluid flow when manually pinched, as described in U.S. Pat. No. 4,183,684; a rupturable diaphram as described in U.S. Pat. No. 3,301,390, a device that is internally punctured by the application of manual pressure such as described in U.S. Pat. No. 2,907,173; an internal tear seal device such as described in U.S. Pat. No. 3,294,227; etc.

Thus, it should be apparent many different types of separator means can be employed which provides sealing separation between the two compartments and which can be mechanically actuated to remove the sealing separation to implement the operation of the device of the invention.

While the device of the invention has been described and illustrated in detail, it is to be clearly understood that this is intended by the way of illustration and example only and is not to be taken by way of limitations, the spirit and scope of this invention being limit only by the terms of the following claims.

I claim:

1. A compartmented pouch for use in placing a fluid onto the surface of an object comprising:

at least two sealed compartments formed in said pouch, separator means other than a breakaway sealing partition for forming a sealing separator between said compartments, a first one of said compartments having a surface thereof stencilled to form at least one opening, removable means placed on the stencilling surface, and a fluid placed in a second one of said compartments wherein when said separator means is mechanically actuated to remove the sealing separation, the fluid in the second one of said compartments is caused to enter said first one of said compartments, whereby with the removable means removed from the stencilled surface and the stencilled surface placed against the surface of the object to receive the fluid the fluid passes through the opening in the stencilled surface onto the surface of the object.

2. The pouch of claim 1 wherein said one of said surfaces is stencilled in the form of a predetermined image to be marked on the surface of the object, said fluid being an image making fluid, whereby said image is marked on the surface of the object when the fluid passes through the stencilled surface.

3. The pouch of claim 2 wherein there are two fluids which are admixed with each other to form the marking fluid, one or the other of said fluids being internally contained within each of said two compartments.

4. The pouch of claim 1 wherein said separator means comprises, mechanical clamp means for clamping said pouch between said compartments.

5. The pouch of claim 1 wherein said separator means comprises value means installed in said pouch between said compartments.

* * * * *